US011206889B2

(12) United States Patent
Samuel, Jr.

(10) Patent No.: US 11,206,889 B2
(45) Date of Patent: Dec. 28, 2021

(54) SAFETY HAT ASSEMBLY

(71) Applicant: Carl Samuel, Jr., Bronx, NY (US)

(72) Inventor: Carl Samuel, Jr., Bronx, NY (US)

( * ) Notice: Subject to any disclaimer, the term of this patent is extended or adjusted under 35 U.S.C. 154(b) by 87 days.

(21) Appl. No.: 16/748,093

(22) Filed: Jan. 21, 2020

(65) Prior Publication Data

US 2021/0219646 A1 Jul. 22, 2021

(51) Int. Cl.
*A42B 3/22* (2006.01)
*A42B 3/04* (2006.01)
*A42B 3/12* (2006.01)

(52) U.S. Cl.
CPC ..... *A42B 3/0406* (2013.01); *A42B 3/12* (2013.01); *A42B 3/221* (2013.01)

(58) Field of Classification Search
CPC ..... A42B 3/221; A42B 3/0406; A42B 3/12
See application file for complete search history.

(56) References Cited

U.S. PATENT DOCUMENTS 2,302,231 A * 11/1942 Lobelle ..... A42B 3/22 2/10
3,310,811 A * 3/1967 Iacono, Jr. ..... A42B 3/08 2/6.5
3,400,407 A * 9/1968 Aileo ..... A42B 3/228 2/6.5
3,543,308 A * 12/1970 Stapenhill ..... A42B 3/226 2/6.4
3,970,082 A 7/1976 Leight
4,227,520 A * 10/1980 Lord ..... A42B 3/28 128/201.24
4,425,917 A 1/1984 Kuznetz
5,283,914 A * 2/1994 James ..... A42B 3/16 128/201.24
5,581,807 A * 12/1996 Peterson ..... A42B 1/247 2/10
6,959,989 B2 11/2005 Holm
7,908,668 B2 * 3/2011 Folkesson ..... G02B 27/0176 2/6.3
8,117,677 B2 2/2012 Toth
8,286,269 B2 10/2012 Springer
8,529,082 B1 * 9/2013 Baker ..... A42B 3/044 362/105
9,566,497 B2 * 2/2017 Erb ..... A42B 3/127
10,030,864 B2 7/2018 Lombard
2004/0226077 A1 11/2004 Toth
2007/0261153 A1 11/2007 Wise
(Continued)

FOREIGN PATENT DOCUMENTS

GB 2532665 8/2013
WO WO9856268 6/1997

*Primary Examiner* — Tajash D Patel

(57) ABSTRACT

A safety hat assembly for enhancing safety and comfort of a user includes a hat that is selectively sizable to a head of a user and which has a brim coupled thereto. The hat is positionable on the head of the user with the brim extending over a forehead of the user. A pair of safety glasses is slidably engaged to the hat and is selectively positionable in a stowed configuration within the hat and a deployed configuration to protect eyes of the user. An earplug is engaged to and selectively extendible from the hat to allow insertion into a respective ear canal of the user to protect hearing of the user. A set of pads is engaged to and positioned within the hat to cushion the head of the user.

18 Claims, 7 Drawing Sheets

(56) References Cited

U.S. PATENT DOCUMENTS

| | | | | |
|---|---|---|---|---|
| 2009/0184646 | A1 | 7/2009 | Devaney | |
| 2010/0281605 | A1 | 11/2010 | Pereira | |
| 2011/0225707 | A1 | 6/2011 | Millios | |
| 2014/0317834 | A1 * | 10/2014 | Power | A42B 3/221 2/411 |
| 2018/0250168 | A1 | 9/2018 | Herring | |

* cited by examiner

SAFETY HAT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

The Names of the Parties to a Joint Research Agreement

Not Applicable

Incorporation-by-Reference of Material Submitted on a Compact Disc or as a Text File Via the Office Electronic Filing System Not Applicable

Statement Regarding Prior Disclosures by the Inventor or Joint Inventor

Not Applicable

BACKGROUND OF THE INVENTION

(1) Field of the Invention

The disclosure relates to hat assemblies and more particularly pertains to a new hat assembly for enhancing safety and comfort of a user.

(2) Description of Related Art Including Information Disclosed Under 37 CFR 1.97 and 1.98

The prior art relates to hat assemblies. Prior art hat assemblies generally comprise a hat that includes a single element, such as deployable safety glasses, deployable earplugs, or cooling pads, that enhance either one aspect of comfort or one aspect of safety. Prior art hat assemblies do not teach specific combinations of safety elements and comfort elements as provided herein.

BRIEF SUMMARY OF THE INVENTION

An embodiment of the disclosure meets the needs presented above by generally comprising a hat that is configured to be selectively sizable to a head of a user. The hat has a brim coupled thereto. The hat is configured to be positioned on the head of the user with the brim extending over a forehead of the user. In one embodiment, the hat is rigid and thus configured to protect the head of the user from an impact force. In another embodiment, the hat comprises resilient plastic, or other resilient material, such as cloth, canvas, and the like.

A pair of safety glasses is slidably engaged to the hat. The safety glasses are selectively positionable in a stowed configuration within the hat and a deployed configuration, wherein the safety glasses are positioned over and configured to protect eyes of the user. An earplug is engaged to and selectively extendible from the hat. The earplug is configured for insertion into a respective ear canal of the user to protect hearing of the user. A set of pads is engaged to and positioned within the hat and is configured to cushion the head of the user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
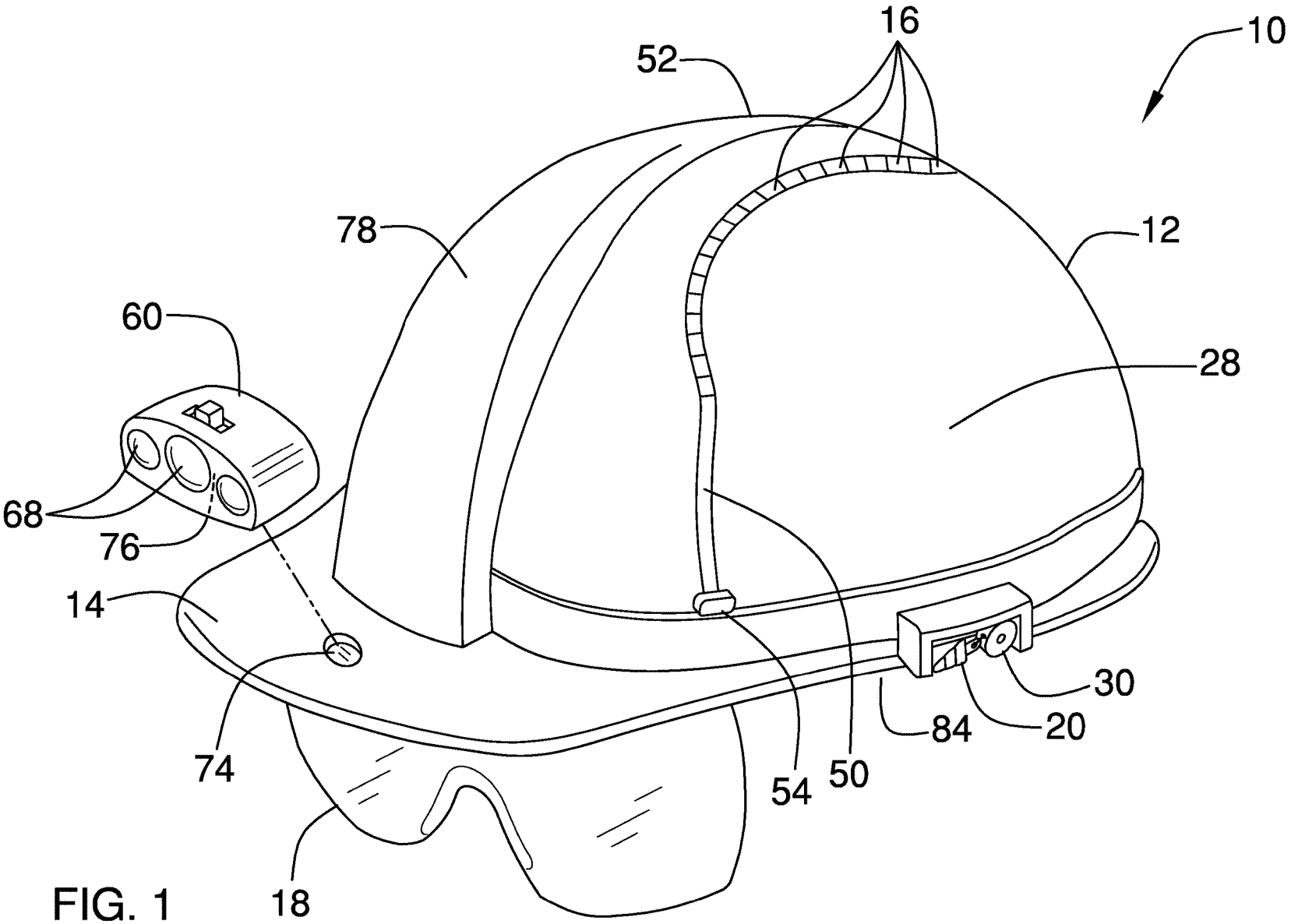
FIG. 1 is an isometric perspective view of a safety hat assembly according to an embodiment of the disclosure.
Figure 2:
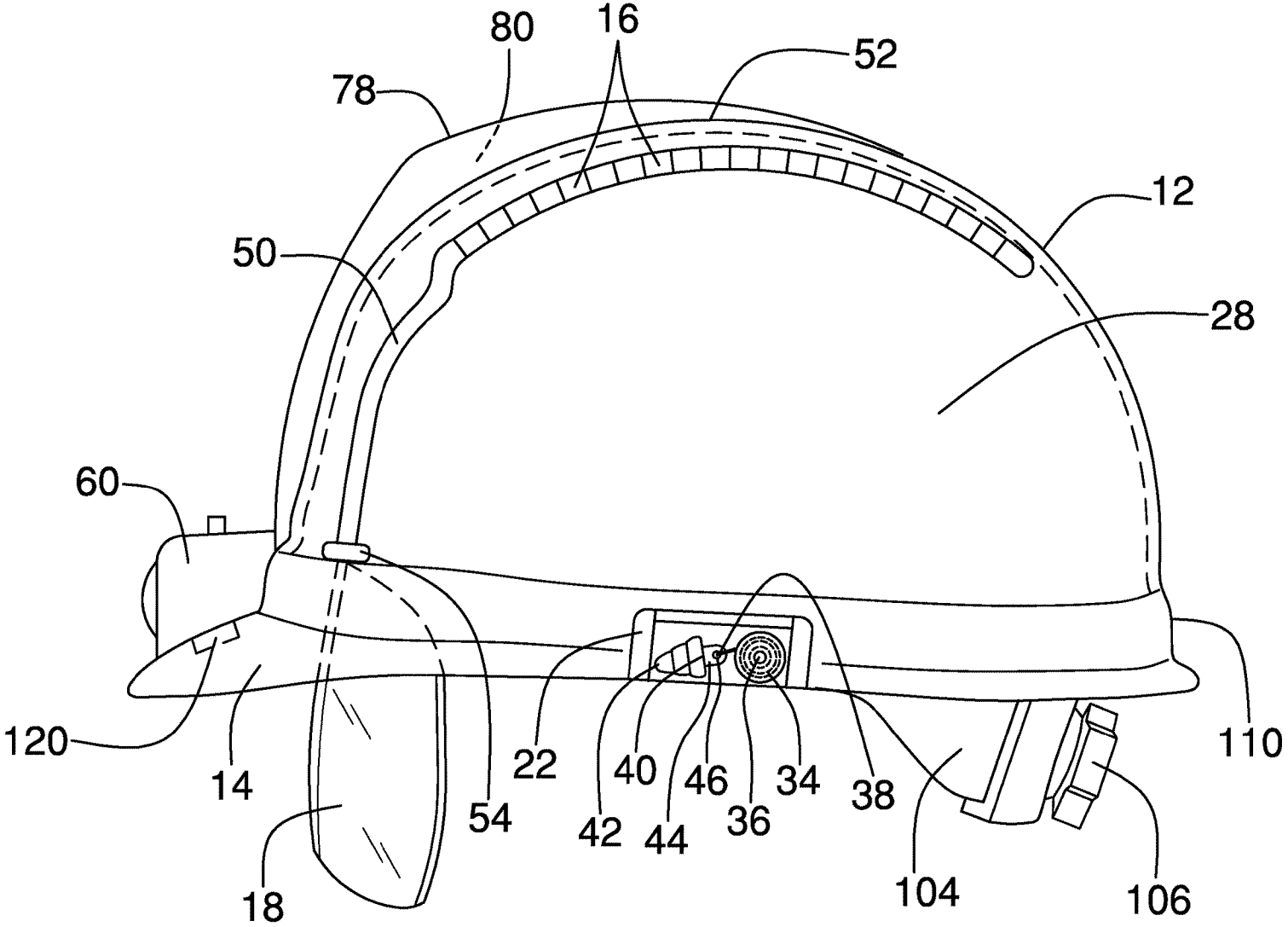
FIG. 2 is a side view of an embodiment of the disclosure.

With reference now to the drawings, and in particular to FIGS. 1 through 7 thereof, a new hat assembly embodying the principles and concepts of an embodiment of the disclosure and generally designated by the reference numeral 10 will be described.

As best illustrated in FIGS. 1 through 7, the safety hat assembly 10 generally comprises a hat 12 that is configured to be selectively sizable to a head of a user. The hat 12 has a brim 14 coupled thereto. The hat 12 is configured to be positioned on the head of the user with the brim 14 extending over a forehead of the user. The hat 12 has a plurality of apertures 16 positioned therein, which is configured to vent the hat 12.

Figure 4:
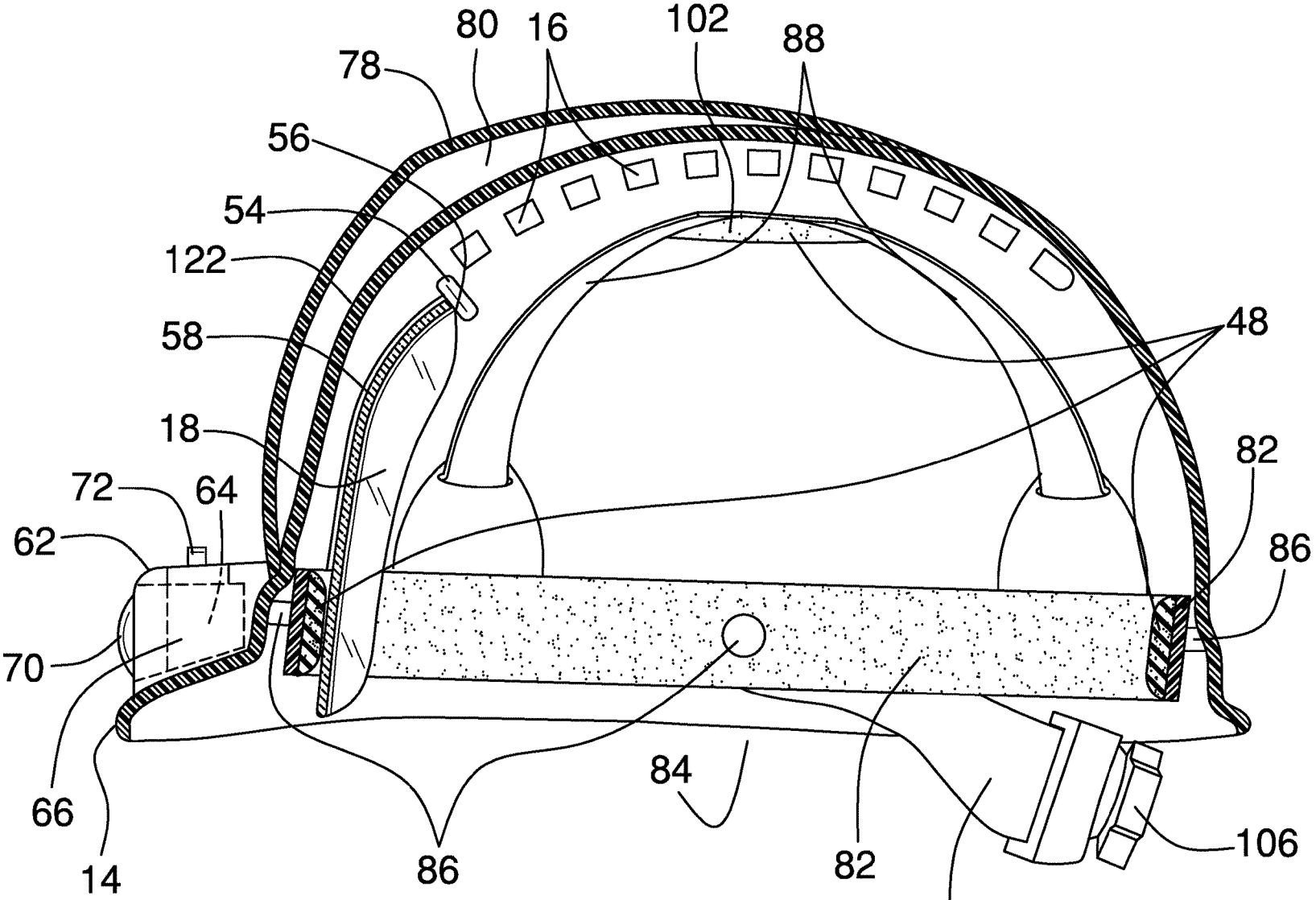
FIG. 4 is a cross-sectional view of an embodiment of the disclosure.
Figure 5:
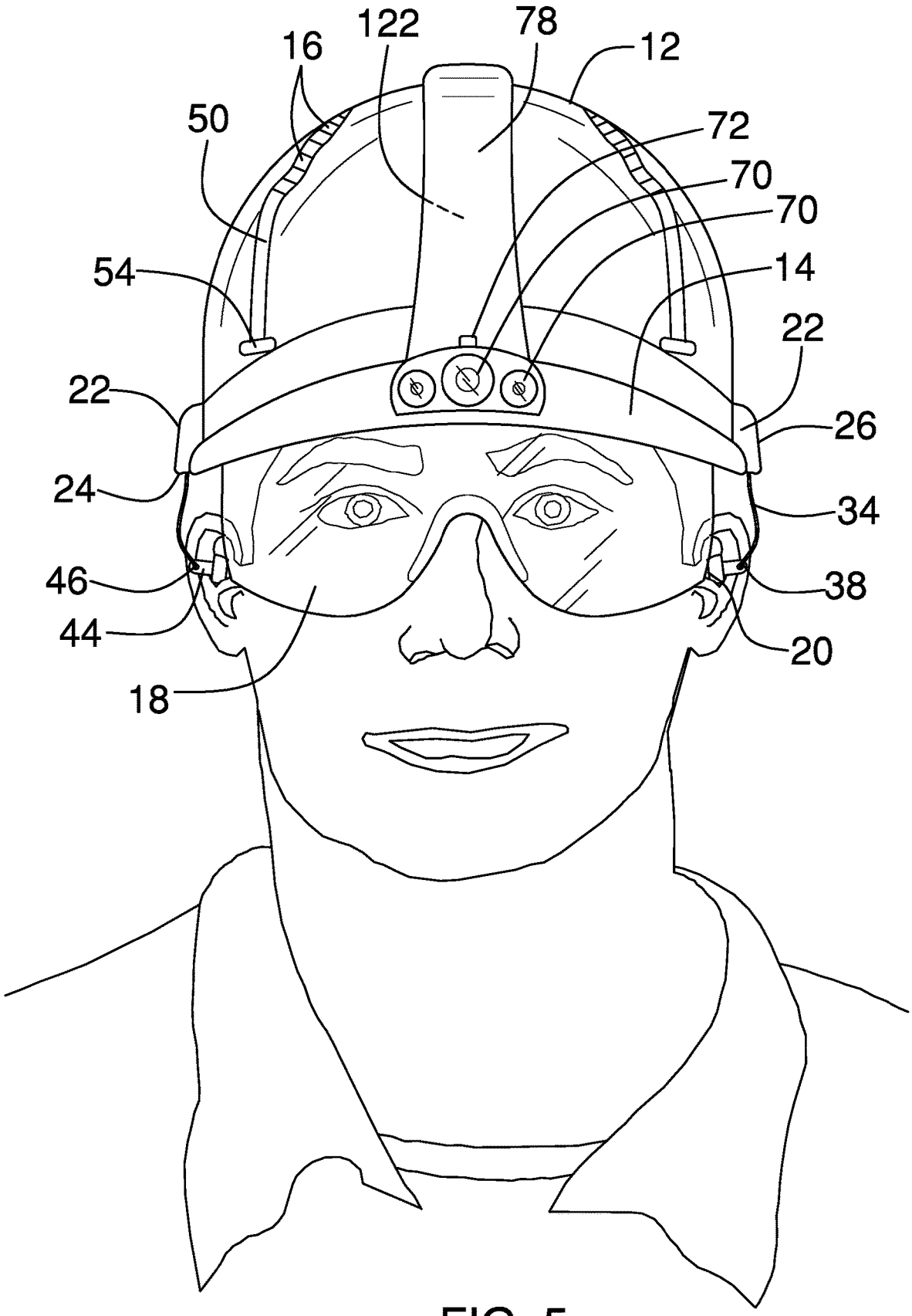
FIG. 5 is an in-use view of an embodiment of the disclosure.
Figure 6:
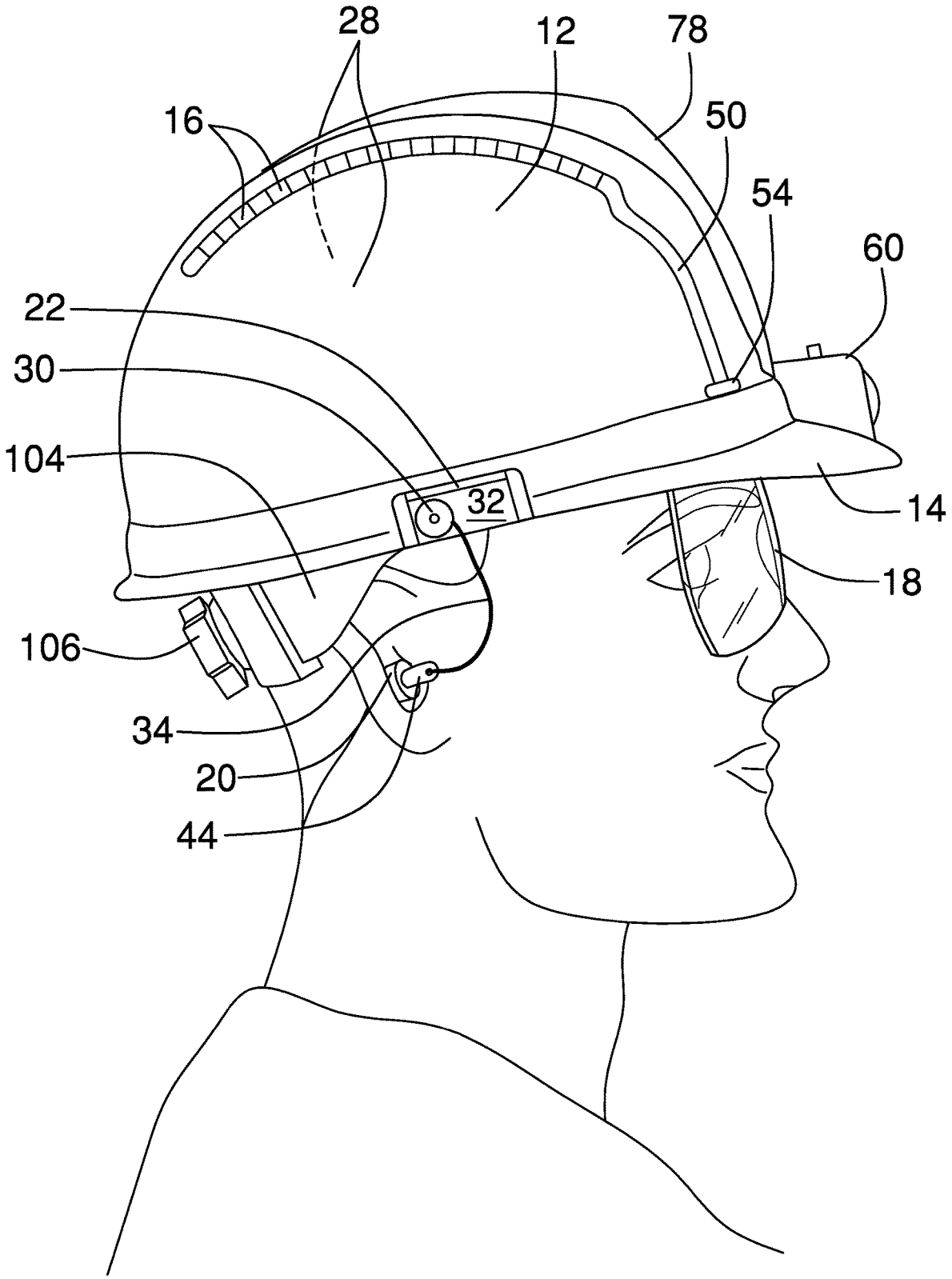
FIG. 6 is an in-use view of an embodiment of the disclosure.

A pair of safety glasses 18 is slidably engaged to the hat 12. The safety glasses 18 are selectively positionable in a stowed configuration within the hat 12, as shown in FIG. 4, and a deployed configuration, as shown in FIG. 5, wherein the safety glasses 18 are positioned over and configured to protect eyes of the user. The safety glasses 18 may be clear or tinted.

Figure 3:
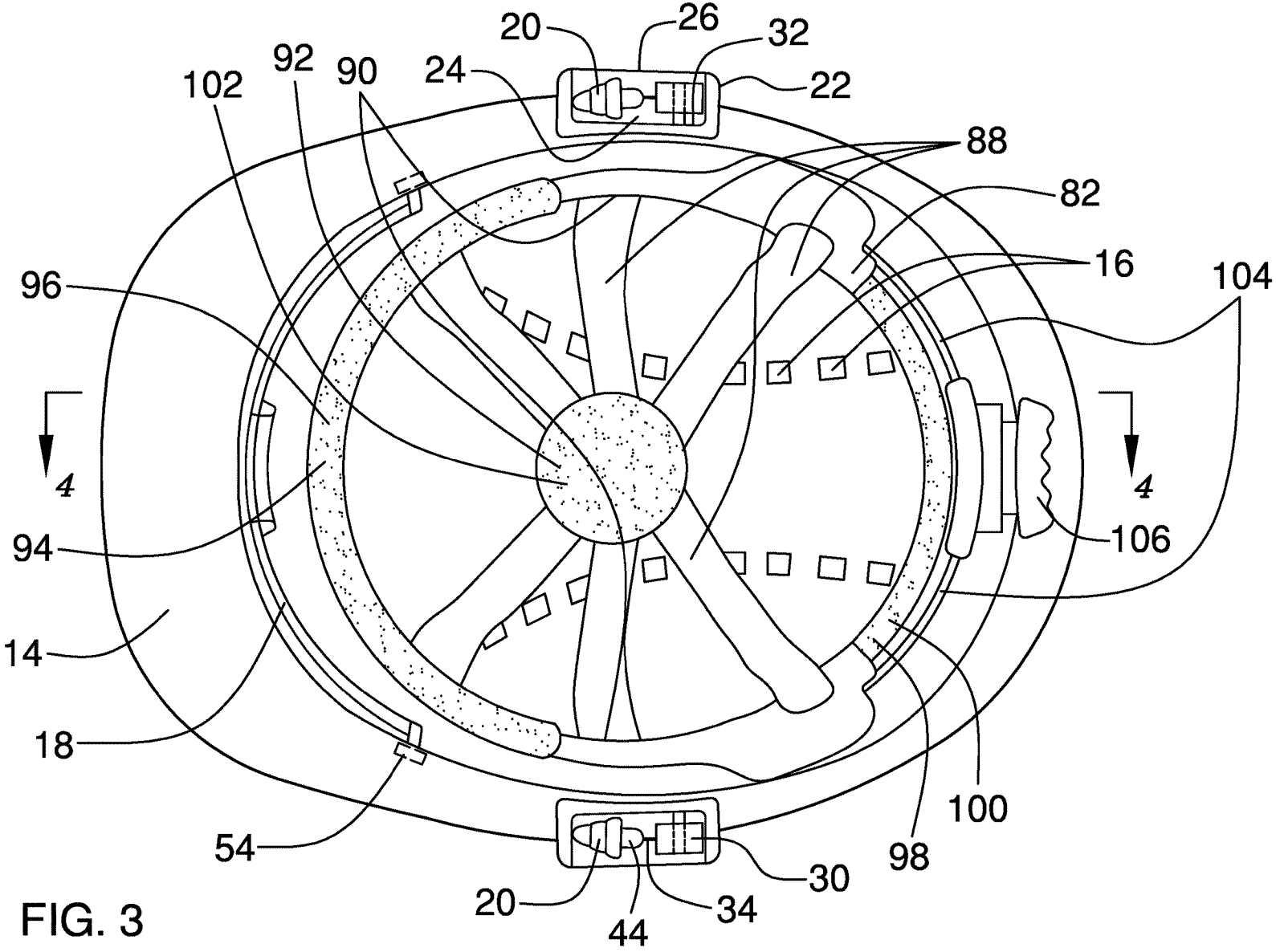
FIG. 3 is a bottom view of an embodiment of the disclosure.

An earplug 20 is engaged to and selectively extendible from the hat 12. The earplug 20 is configured for insertion into a respective ear canal of the user to protect hearing of the user. As shown in FIG. 3, each opposed side 28 of the hat 12 has an earplug 20 engaged thereto. The earplug 20 is positioned in a shell 22 that is coupled to the hat 12. The shell 22 is positioned proximate to the respective ear of the user when the hat 12 is donned. The shell 22 has a lower face 24 and an outside face 26 that are open, allowing the user access to the earplug 20.

A spool 30, which is spring loaded, is axially coupled to an inner face 32 of the shell 22. A cord 34 is coupled by a first end 36 to the spool 30. The cord 34 is wound around the spool 30 so that the cord 34 is selectively extensible from the shell 22. The earplug 20 is coupled to a second end 38 of the cord 34 so that the earplug 20 is selectively extendible from the shell 22, positioning the user to insert the earplug 20 into the respective ear canal. The earplug 20 is conically shaped, thus defining a base 40 and apex 42 of the earplug 20. The base 40 has a tab 44 coupled thereto and extending therefrom. The tab 44 has a hole 46 positioned therethrough. The second end 38 of cord 34 is reversibly engaged to the tab 44, via the hole 46, so that the earplug 20 is replaceable.

A set of pads 48 is engaged to and positioned within the hat 12 and is configured to cushion the head of the user. The set of pads 48 comprises at least one of refrigerant gel and phase change material so that the set of pads 48 is configured to cool the head of the user. If cooling during use of the hat 12 is desirable, the hat 12 would be stored in a cold environment, such as a freezer, prior to use.

The hat 12 has a slot 50 positioned therein and extending from proximate to the brim 14 toward a top 52 of the hat 12, as shown in FIG. 5. A knob 54 is coupled to and extends transversely from an upper end 56 of the safety glasses 18 through the slot 50. The knob 54 is configured to be gripped in digits of a hand of the user, enabling the user to selectively position the safety glasses 18 in the stowed configuration and the deployed configuration. As shown in FIG. 3, each opposed side 28 has a slot 50 positioned therein with each slot 50 having a knob 54 positioned therethrough. This configuration allows the user to deploy the safety glasses 18 with either one of the user's hands, or with both hands.

The knob 54 is selectively couplable to the hat 12 with the safety glasses 18 in the deployed configuration. A spring 58 is coupled to the hat 12 proximate to the brim 14, and to the knob 54 so that the spring 58 is compressed as the safety glasses 18 are positioned in the deployed configuration. The spring 58 is positioned to rebound upon decoupling of the knob 54 from the hat 12 to return the safety glasses 18 to the stowed configuration.

A lighting unit 60 is engaged to the brim 14 and is configured to illuminate an area proximate to the user. The lighting unit 60 may be configured for intermittent illumination of the area proximate to the user.

The lighting unit 60 comprises an illumination housing 62 that defines an interior space 64. A battery 66 is positioned in the interior space 64. The battery 66 may be rechargeable. A set of bulbs 68 is coupled to the illumination housing 62 and is configured to illuminate the area proximate to the user. Each bulb 48 may comprise a light emitting diode 70, as shown in FIG. 5. A switch 72 is coupled to the illumination housing 62 and is operationally coupled to the set of bulbs 68 and the battery 66. The switch 72 is configured to be selectively switched to operationally couple the set of bulbs 68 to the battery 66.

A first connector 74 is coupled to the brim 14 and a second connector 76 is coupled to the illumination housing 62. The second connector 76 is complementary to the first connector 74 so that the second connector 76 is positioned to selectively couple to the first connector 74 to removably engage the illumination housing 62 to the brim 14. The second connector 76 and the first connector 74 may comprise a snap connector 120, as shown in FIG. 1, or other connecting means, such as, but not limited to, hook and loop connectors, magnetic connectors, and the like.

In one embodiment, as shown in FIG. 1-6, the hat 12 is rigid and thus configured to protect the head of the user from an impact force. The hat 12 may comprise at least one of rigid plastic and carbon fiber, or other rigid material or combination of materials, such as, but not limited to metal, fiberglass, and the like.

A plate 78 is coupled to and extends between the top 52 of the hat 12 and the brim 14 so that the hat 12 and the plate 78 define an internal space 80, as shown in FIG. 4. The plate 78 is configured to enhance resistance to an impact force that is applied to a front 122 of the hat 12.

A ring 82 is positioned in the hat 12 proximate to a bottom 84 of the hat 12. Each of a plurality of connectors 86 is coupled to and extends between the hat 12 and the ring 82, as shown in FIG. 4, so that the ring 82 is substantially fixedly positioned proximate to the bottom 84 of the hat 12. Each of a set of head straps 88 has opposed ends 90 that are coupled to the ring 82 so that the opposed ends 90 are opposingly positioned on the ring 82.

A disc 92 is coupled to the set of head straps 88 so that the disc 92 is positioned equally distant from the opposed ends 90 of each head strap 88. The set of head straps 88 and the disc 92 are configured to dissipate the impact force that is applied to the hat 12.

In this embodiment, the set of pads 48 comprises a first pad 94 that is coupled to a forward section 96 of the ring 82, a second pad 98 that is coupled to a rearward section 100 of the ring 82, and a third pad 102 that is coupled to the disc 92.

Each of a pair of side straps 104 is coupled to and extends from the ring 82, as shown in FIG. 4. A ratcheting dial 106 is coupled to the pair of side straps 104 and is configured to be selectively turned to tighten the pair of side straps 104 to the head of the user.

Figure 7:
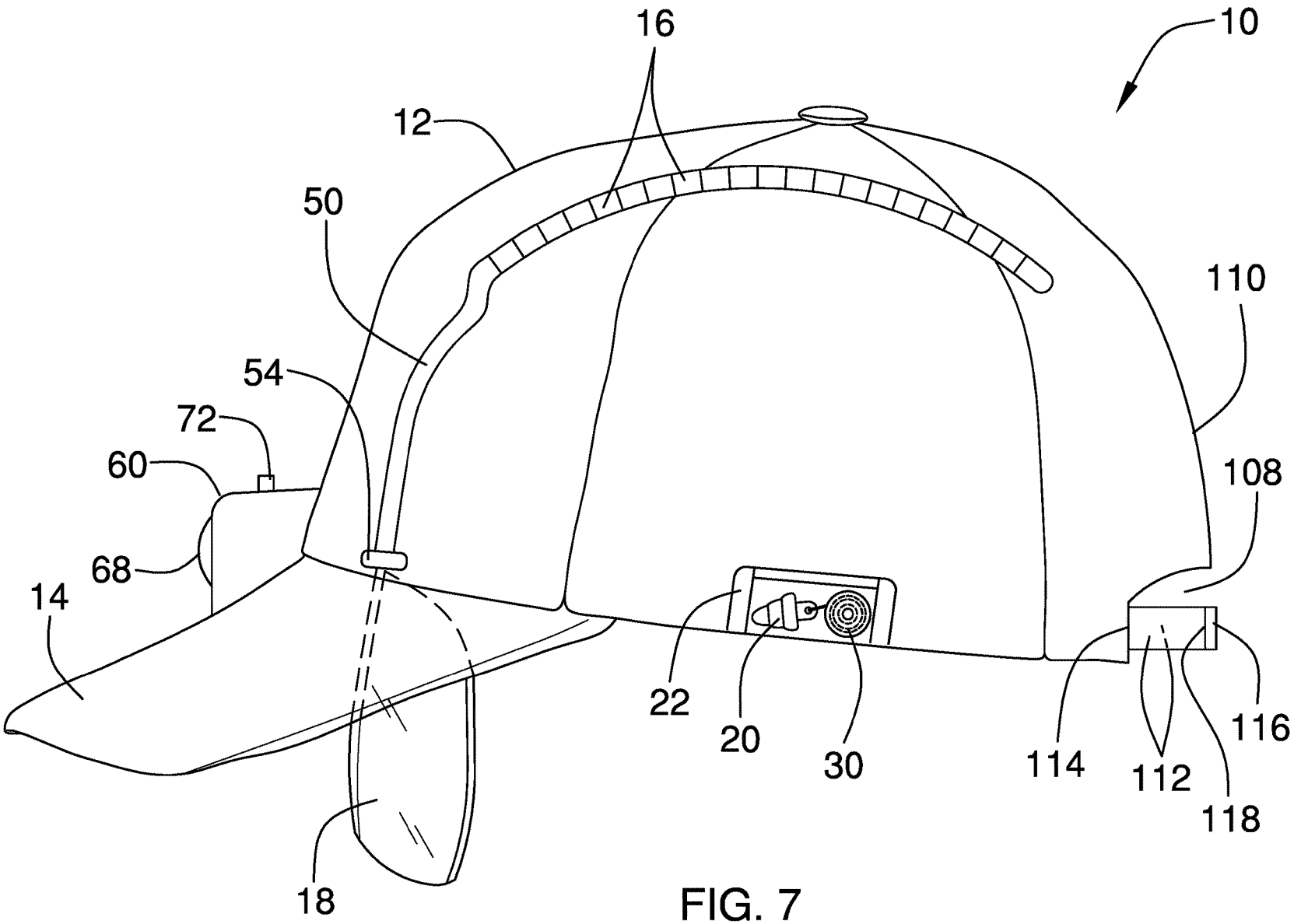
FIG. 7 is a side view of an alternative embodiment of the disclosure.

In another embodiment, as shown in FIG. 7, the hat 12 comprises resilient plastic, or other resilient material, such as cloth, canvas, and the like. The hat 12 of this embodiment thus is configured to shield the head of the user from the elements and minor impacts.

The hat 12 has a cutout 108 positioned in a back 110 thereof and extending from the bottom 84 toward the top 52. Each of a pair of tightening straps 112 is coupled by a first terminus 114 to the hat 12 proximate to the cutout 108. Each tightening strap 112 has a fastener 116 coupled proximate to a second terminus 118 thereof. The fasteners 116 are selectively mutually couplable to tighten the hat 12 to the head of the user. The fasteners 116 may comprise an elastic band, hook and loop fasteners, snap closures, and the like.

In use, the hat 12 is donned by the user with the brim 14 extending over the user's forehead. The pads 48 cushion the head of the user and, if prechilled, provide cooling for the head. The set of bulbs 68, the safety glasses 18, and the earplugs 20 are available to the user as needed for illumination, eye protection, and ear protection, respectively.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user; and a set of pads engaged to and positioned within the hat wherein the set of pads is configured for cushioning the head of the user, wherein the set of pads comprises at least one of refrigerant gel and phase change material wherein the set of pads is configured for cooling the head of the user.

2. The safety hat assembly of claim 1, wherein the hat has a plurality of apertures positioned therein wherein the apertures are configured for venting the hat.

3. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

a shell coupled to the hat such that the shell is positioned proximate to the respective ear of the user when the hat is donned, the shell having a lower face and an outside face, the lower face and the outside face being open;

a spool axially coupled to an inner face of the shell, the spool being spring loaded; and a cord having a first end coupled to the spool, the cord being wound around the spool such that the cord is selectively extensible from the shell, the earplug being coupled to a second end of the cord such that the earplug is selectively extendible from the shell positioning the user for inserting the earplug into the respective ear canal.

4. The safety hat assembly of claim 3, wherein the earplug is conically shaped defining a base and apex of the earplug, the base having a tab coupled thereto and extending therefrom, the tab having a hole positioned therethrough, the second end of cord being reversibly engaged to the tab via the hole such that the earplug is replaceable.

5. The safety hat assembly of claim 1, further including:

the hat having a slot positioned therein and extending from proximate to the brim toward a top of the hat; and a knob coupled to and extending transversely from an upper end of the safety glasses through the slot wherein the knob is configured for gripping in digits of a hand of the user enabling the user for selectively positioning the safety glasses in the stowed configuration and the deployed configuration.

6. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

the hat having a slot positioned therein and extending from proximate to the brim toward a top of the hat;

a knob coupled to and extending transversely from an upper end of the safety glasses through the slot wherein the knob is configured for gripping in digits of a hand of the user enabling the user for selectively positioning the safety glasses in the stowed configuration and the deployed configuration;

the knob being selectively couplable to the hat with the safety glasses in the deployed configuration; and a spring coupled to the hat proximate to the brim, the spring being coupled to the knob such that the spring is compressed as the safety glasses are positioned in the deployed configuration such that the spring is positioned for rebounding upon decoupling of the knob from the hat for returning the safety glasses to the stowed configuration.

7. The safety hat assembly of claim 1, further including a lighting unit engaged to the brim wherein the lighting unit is configured for illuminating an area proximate to the user.

8. The safety hat assembly of claim 7, wherein the lighting unit is configured for intermittent illumination of the area proximate to the user.

9. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

a lighting unit engaged to the brim wherein the lighting unit is configured for illuminating an area proximate to the user, wherein the lighting unit comprises:

an illumination housing defining an interior space;

a battery positioned in the interior space, the battery being rechargeable;

a set of bulbs coupled to the illumination housing wherein the set of bulbs is configured for illuminating the area proximate to the user, and a switch coupled to the illumination housing, the switch being operationally coupled to the set of bulbs and the battery wherein the switch is configured for being selectively switched for operationally coupling the set of bulbs to the battery.

10. The safety hat assembly of claim 9, further including:

a first connector coupled to the brim; and a second connector coupled to the illumination housing, the second connector being complementary to the first connector such that the second connector is positioned for selectively coupling to the first connector from removably engaging the illumination housing to the brim.

11. The safety hat assembly of claim 1, wherein the hat comprises at least one of rigid plastic and carbon fiber such that the hat is rigid, wherein the hat is configured for protecting the head of the user from an impact force.

12. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

wherein the hat comprises at least one of rigid plastic and carbon fiber such that the hat is rigid, wherein the hat is configured for protecting the head of the user from an impact force; and a plate coupled to and extending between the top of the hat and the brim such that the hat and the plate define an internal space wherein the plate is configured for enhancing resistance to an impact force applied to a front of the hat.

13. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

wherein the hat comprises at least one of rigid plastic and carbon fiber such that the hat is rigid, wherein the hat is configured for protecting the head of the user from an impact force;

a ring positioned in the hat proximate to a bottom of the hat;

a plurality of connectors, each connector being coupled to and extending between the hat and the ring such that the ring is substantially fixedly positioned proximate to the bottom of the hat;

a set of head straps, each head strap having opposed ends coupled to the ring such that the opposed ends are opposingly positioned on the ring;

a disc coupled to the set of head straps such that the disc is positioned equally distant from the opposed ends of each head strap wherein the set of head straps and the disc are configured for dissipating the impact force; and the set of pads comprising a first pad coupled to a forward section of the ring, a second pad coupled to a rearward section of the ring, and a third pad coupled to the disc.

14. The safety hat assembly of claim 13, further including:

a pair of side straps, each side strap being coupled to and extending from the ring; and a ratcheting dial coupled to the pair of side straps wherein the ratcheting dial is configured for being selectively turned for tightening the pair of side straps to the head of the user.

15. A safety hat assembly comprising:

a hat configured to be selectively sizable to a head of a user, the hat having a brim coupled thereto wherein the hat is configured for positioning on the head of the user with the brim extending over a forehead of the user;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a set of pads engaged to and positioned within the hat wherein the set of pads is configured for cushioning the head of the user;

the hat comprising resilient plastic;

the hat having a cutout positioned in a back thereof and extending from the bottom toward the top; and a pair of tightening straps, each tightening strap being coupled by a first terminus to the hat proximate to the cutout, each tightening strap having a fastener coupled proximate to a second terminus thereof, the fasteners being selectively mutually couplable for tightening the hat to the head of the user.

16. A safety hat assembly comprising:

a hat configured to be selectively sizable to a head of a user, the hat having a brim coupled thereto wherein the hat is configured for positioning on the head of the user with the brim extending over a forehead of the user, the hat having a plurality of apertures positioned therein wherein the apertures are configured for venting the hat, the hat having a slot positioned therein and extending from proximate to the brim toward a top of the hat;

a pair of safety glasses slidably engaged to the hat such that the safety glasses are selectively positionable in a stowed configuration within the hat and a deployed configuration wherein the safety glasses are positioned over and configured for protecting eyes of the user;

an earplug engaged to and selectively extendible from the hat wherein the earplug is configured for insertion into a respective ear canal of the user for protecting hearing of the user;

a shell coupled to the hat such that the shell is positioned proximate to the respective ear of the user when the hat is donned, the shell having a lower face and an outside face, the lower face and the outside face being open;

a spool axially coupled to an inner face of the shell, the spool being spring loaded;

a cord having a first end coupled to the spool, the cord being wound around the spool such that the cord is selectively extensible from the shell, the earplug being coupled to a second end of the cord such that the earplug is selectively extendible from the shell positioning the user for inserting the earplug into the respective ear canal, the earplug being conically shaped defining a base and apex of the earplug, the base having a tab coupled thereto and extending therefrom, the tab having a hole positioned therethrough, the second end of cord being reversibly engaged to the tab via the hole such that the earplug is replaceable;

a set of pads engaged to and positioned within the hat wherein the set of pads is configured for cushioning the head of the user, the set of pads comprising at least one of refrigerant gel and phase change material wherein the set of pads is configured for cooling the head of the user;

a knob coupled to and extending transversely from an upper end of the safety glasses through the slot wherein the knob is configured for gripping in digits of a hand of the user enabling the user for selectively positioning the safety glasses in the stowed configuration and the deployed configuration, the knob being selectively couplable to the hat with the safety glasses in the deployed configuration;

a spring coupled to the hat proximate to the brim, the spring being coupled to the knob such that the spring is compressed as the safety glasses are positioned in the deployed configuration such that the spring is positioned for rebounding upon decoupling of the knob from the hat for returning the safety glasses to the stowed configuration;

a lighting unit engaged to the brim wherein the lighting unit is configured for illuminating an area proximate to the user, the lighting unit being configured for intermittent illumination of the area proximate to the user, the lighting unit comprising:

an illumination housing defining an interior space, a battery positioned in the interior space, the battery being rechargeable, and a set of bulbs coupled to the illumination housing wherein the set of bulbs is configured for illuminating the area proximate to the user, and a switch coupled to the illumination housing, the switch being operationally coupled to the set of bulbs and the battery wherein the switch is configured for being selectively switched for operationally coupling the set of bulbs to the battery;

a first connector coupled to the brim; and a second connector coupled to the illumination housing, the second connector being complementary to the first connector such that the second connector is positioned for selectively coupling to the first connector from removably engaging the illumination housing to the brim, the second connector and the first connector comprising a snap connector.

17. The safety hat assembly of claim 16, further including:

the hat being rigid wherein the hat is configured for protecting the head of the user from an impact force;

the hat comprising at least one of rigid plastic and carbon fiber;

a plate coupled to and extending between the top of the hat and the brim such that the hat and the plate define an internal space wherein the plate is configured for enhancing resistance to an impact force applied to a front of the hat;

a ring positioned in the hat proximate to a bottom of the hat;

a plurality of connectors, each connector being coupled to and extending between the hat and the ring such that the ring is substantially fixedly positioned proximate to the bottom of the hat;

a set of head straps, each head strap having opposed ends coupled to the ring such that the opposed ends are opposingly positioned on the ring;

a disc coupled to the set of head straps such that the disc is positioned equally distant from the opposed ends of each head strap wherein the set of head straps and the disc are configured for dissipating the impact force;

the set of pads comprising a first pad coupled to a forward section of the ring, a second pad coupled to a rearward section of the ring, and a third pad coupled to the disc;

a pair of side straps, each side strap being coupled to and extending from the ring; and a ratcheting dial coupled to the pair of side straps wherein the ratcheting dial is configured for being selectively turned for tightening the pair of side straps to the head of the user.

18. The safety hat assembly of claim 16, further including:

the hat comprising resilient plastic;

the hat having a cutout positioned in a back thereof and extending from the bottom toward the top; and a pair of tightening straps, each tightening strap being coupled by a first terminus to the hat proximate to the cutout, each tightening strap having a fastener coupled proximate to a second terminus thereof, the fasteners being selectively mutually couplable for tightening the hat to the head of the user.

* * * * *